United States Patent [19]

Ruthardt

[11] Patent Number: 4,522,577

[45] Date of Patent: Jun. 11, 1985

[54] DEVICE FOR MANUFACTURING POWDER BY DIVIDING A MELT

[75] Inventor: Rolf Ruthardt, Hanau am Main, Fed. Rep. of Germany

[73] Assignee: Leybold-Heraeus GmbH, Cologne, Fed. Rep. of Germany

[21] Appl. No.: 510,283

[22] Filed: Jul. 1, 1983

[30] Foreign Application Priority Data

Jul. 10, 1982 [DE] Fed. Rep. of Germany ..... 3225868

[51] Int. Cl.[3] ..... B28B 1/54

[52] U.S. Cl. ..... 425/6; 264/5; 264/13; 425/8

[58] Field of Search ..... 425/6, 7, 8, 10; 264/5, 264/8, 13

[56] References Cited

U.S. PATENT DOCUMENTS 3,010,819 11/1961 Naeser et al. ..... 425/6
3,077,307 2/1963 Moore et al. ..... 425/6
4,067,674 1/1978 Devillard ..... 425/8
4,284,394 8/1981 Thompson ..... 264/8

FOREIGN PATENT DOCUMENTS 449781 4/1975 U.S.S.R. ..... 425/8

*Primary Examiner*—Caleb Weston
*Attorney, Agent, or Firm*—Max Fogiel

[57] ABSTRACT

A device for manufacturing powder from a melt by a mechanism for dividing it up. The device has a vertical shaft and a powder outtake that communicates with the shaft. To achieve the objectives of reducing the overall height of such a device and preventing the powder from sintering, the powder outtake consists of the lower section of the shaft and has essentially the same cross-section as the upper section. Both sections, together, essentially determine the overall height of the device. Both sections are connected with a releasable connecting element and can be separated from each other in a direction perpendicular to the axis of the shaft.

7 Claims, 1 Drawing Figure

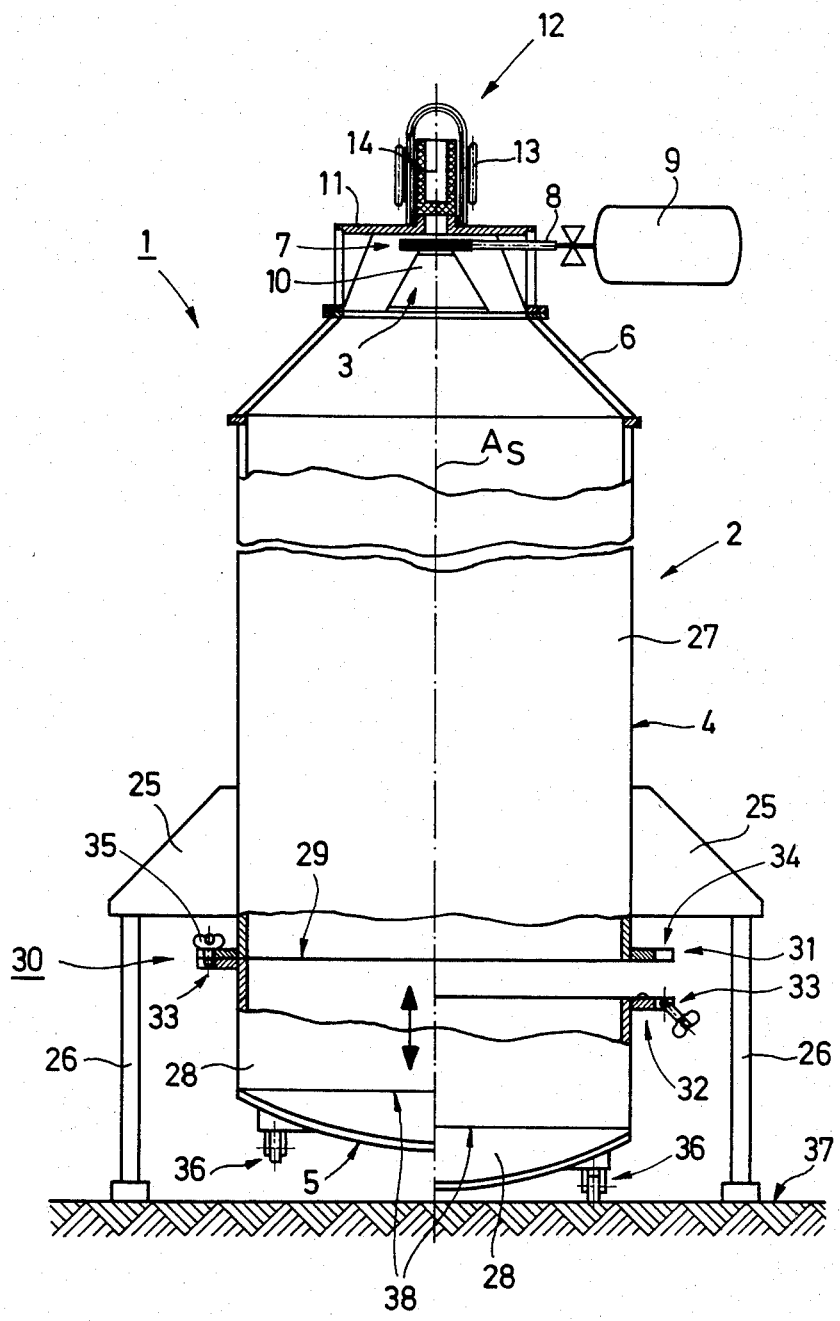
12
14
13
9
11
8
1
7
10
3
6
As
2
27
4
25
25
35
29
34
30
31
33
33
26
28
32
26
36
5
36
37
38
28

DEVICE FOR MANUFACTURING POWDER BY DIVIDING A MELT

The invention concerns a device for manufacturing powder by dividing a melt into particles and then cooling the particles until they harden and consisting of a mechanism for dividing the melt, of a container, which is essentially a vertical shaft with a vertical axis, for cooling the particles, and of a powder outtake that communicates with the shaft.

The device is used to manufacture powder from metals, alloys, and non-metals. State of the art includes a number of devices for dividing melts. One involves disks or crucibles that rotate at high speed, with the melt entering the center and flung off over the edge as the result of centrifugal force in the form of extremely fine particles. Oscillators or resonators that vibrate ultrasonically, breaking up a stream of molten material that comes into contact with them into extremely fine droplets and flinging them off, are also known. An especially effective device for dividing a melt consists of a nozzle that blows highly compressed gas over a flowing melt and breaks it up into extremely fine droplets. The melt is as a rule fed into all these devices in the form of a regulated jet of liquid. It is, however, also possible to introduce the starting material in the form of a solid rod that is melted locally at one end and to divide the resulting melt into particles with centrifugal force, ultrasound, and/or a high-speed flow of gas.

In all known processes for manufacturing powder from a melt it is necessary to subsequently harden the droplets into particles by heat abstraction and to cool them adequately before the next stage, which consists of collecting them on the floor of a container. The particles must be cooled to a temperature at which they will not sinter together again once they have been collected in a layer on the floor of the container to prevent the powder, which generally pours well, from being difficult or impossible to remove.

Even though the particles can be subjected to a horizontal component of motion induced by centrifugal force, ultrasonics, or flowing gas to provide more cooling time before they come to rest on the floor of the container, the effect of gravity on their falling behavior or falling time will still be decisive.

Vertical shafts, with the material to be divided located at the top and with the bottom shaped more or less like a large funnel, below which there is usually a shutoff mechanism and a powder-collecting container, have usually been employed up to now to cool and collect the particles (cf. German Auslegeschrift 2 058 964 and German Offenlegungsschrift 2 528 999).

The funnel, shutoff mechanism, and powder-collecting container function together as a powder outtake.

This design has disadvantages, however. The funnel, which adjoins the shaft coaxially, considerably extends the overall height of the device. Making the funnel shallower would only increase its included angle, which would make the powder harder to extract. Thus, considerations of overall height make it impossible for the funnel to be as slender as desired. An associated drawback is that the powder tends to collect in the lowest, meaning the narrowest, section of the funnel, where it piles up very high, which not only leads to unsatisfactory heat loss but also promotes sintering as a result of unavoidable static pressure in the pile. This can result in downtime.

A device for manufacturing metal powder with a funnel and a shutoff valve is also known from U.S. Pat. No. 3,010,819. The height of the funnel inside the shaft or tower can be adjusted although the position of the longest diameter of the funnel must also be set for the particle-hardening conditions to prevent the funnel from being touched by any liquid or still sinterable particle. Thus, this funnel as well increases the minimum overall height of the device by at least its own height, including the shutoff mechanism and the supporting pipes. The position of the upper edge of the funnel, its conical area, is in other words the parameter that is critical for the distance that the particles fall, and all components located below the edge will necessarily increase the height of the device as a whole.

It is also significant in this context that the car that is rolled out to the side of the device disclosed in U.S. Pat. No. 3,010,819 increase the overall height of the device even more in that it is still positioned below the funnel-shutoff mechanism and the bottom of the shaft. Neither the funnel nor the car however are integral parts of the shaft, but are completely independent of it and can not be tightly connected to it.

German Offenlegungsschrift 3 222 742 proposes reducing the height of a device of this type by positioning the funnel at the side of the shaft and tilting the shaft to empty it. Such a solution, however, because it is expensive to manufacture and operate, is preferable for middle-sized and large plants.

The present invention is intended as a device of the aforesaid type that is extensively improved in that its overall height is much lower even though the shaft does not tilt and in that the tendency of the powder to sinter together is largely counteracted.

This objective is achieved in a device of the type initially described and in accordance with the invention in that the powder outtake consists of the lower section of the shaft and has essentially the same cross-section as the upper section and in that both sections are connected with a releasable connecting element and can be separated from each other in a direction perpendicular to the axis $A_S$ of the shaft.

In the object of the invention the combined lengths of the two sections of the shaft is the parameter that is critical for the distance that the particles fall. The distance of the bottom circumferential edge of the lower section of the device must in other words be adjusted to the particle-hardening conditions in such a way that the particles will neither be liquid nor tend to sinter together at that point.

In other words again, the bottom circumferential edge of the lower section of the object of the present invention corresponds to the upper edge of the funnel in the object of U.S. Pat. No. 3,010,819. Whereas the only height that is added to the preferred embodiment of the object of the present invention, which has a concave floor below the circumferential edge, is that of the floor, the object of U.S. Pat. No. 3,010,819 must incorporate the much greater total height of the funnel, the shutoff mechanism, the car, and in certain cases the vertical distance between the shutoff mechanism and the car. The object of the present invention is accordingly distinguished by its minimal overall height.

The invention as a whole will be especially practical if the connecting element consists of two flanges that can be fastened together with height-adjusting screws. The lower section of the shaft can then be raised and lowered by screwing and unscrewing the height-adjusting screws, which can very simply be swing bolts held in place by wing nuts, and the lower section subsequently laterally displaced in relation to the upper section.

It is also especially practical if the lower section has transport wheels that will support it when the height-adjusting screws are unscrewed to lower it. Such wheels will define the maximum distance between the flanges.

It is on the other hand not necessary to put wheels on the lower section. It is also possible for example to rest it on vertical pivots so that it can be pivoted horizontally out from under the upper section. It is also possible to displace or pivot the essentially larger upper section of the shaft in relation to the lower shaft, although this would only be practical in special cases because of the greater mass that would have to be moved.

Ideally, the floor is shaped like a spherical surface with a center of curvature that is essentially in the vicinity of the mechanism for dividing the melt. In accordance with this principle all the particles will travel essentially the same path to arrive at the floor.

Another advantage of the object of the invention is that the the surface on which the powder collects will also be considerably expanded, being essentially identical to the cross-section of the shaft. This will not only distribute the powder over a larger area but will also bring it into closer contact with the cooled floor of the shaft. The pile will also be a lot shallower, which will go a long way toward preventing sintering.

Furthermore, pressure and temperature are conditions that notoriously affect the sintering of particles of powder, and both of these parameters can be considerably reduced by the design of the device in accordance with the invention.

Both sections of the shaft are rigidly connected while the powder is being manufactured. When the powder is finished, the lower section is removed from under the upper section, horizontally for example, and the powder can be removed from it through its open top, which has a cross-section identical to that of the shaft as a whole. A preferred method of removing the particles is with a suction device on the order of a vacuum cleaner.

The device operates discontinuously of course, which is not a disadvantage in smaller plants and laboratories.

One embodiment of the invention will now be specified by way of example with reference to the single FIGURE the left half of which illustrates a device with powder in the course of manufacture, with the two sections fastened together, that is, and the right half the same device with the lower section lowered and ready to be displaced for removal of the powder.

A device 1 for manufacturing powder by dividing a melt into particles and then cooling the particles until they harden has a shaft 2 with an axis $A_S$ and a mechanism 3 for dividing a melt. Shaft 2 has a cylindrical jacket 4, a spherically concave floor 5, and a conical transitional section 6.

Mechanism 3 for dividing the melt consists of a nozzle 7 that has an annular outlet and that can be connected through a line 8 to a source 9 of compressed gas. Nozzle 7 and a distributor horn 10 are housed in the roof 11 of shaft 2 that can be attached to and removed from transitional section 6. A source 12 of molten material in the form of crucible 14 heated by an induction coil 13 is mounted on and can be removed from roof 11. Its bottom, which can be opened and closed and is positioned coaxial to and above nozzle 7, is not illustrated in detail. Shaft 2, especially floor 5 and roof 11, is double-walled, and a coolant circulates inside the wall. The design and operation of both mechanism 3 and molten-material source 12 are state of the art and are therefore not specified. When mechanism 3 is in operation it precipitates droplets of molten metal into shaft 2 that fall through it and, once they have hardened and cooled to the desired temperature, collect on floor 5.

Shaft 2 ia mounted on lateral and diametrically opposed claws 25 on several posts 26. Only the rear posts are illustrated. The gas outlet is not illustrated.

Shaft 2 consists of an upper section 27 and a lower section 28 that mate congruently at a common junction 29. Both sections are attached together gas-tight at junction 29 by means of a connecting element 30. Connecting element 30 consists of an upper flange 31, a lower flange 32, and several height-adjusting screws 33 distributed around the flanges and mounted on tangent hinge pins in lower flange 32 in such a way as to pivot. Each height-adjusting screw 33 pivots into a slot 34 just above it in upper flange 31. Each height-adjusting screw 33 is supplied with a wing nut 35 and, when the screws are in position in slots 34, the nuts can be tightened to force lower section 28 into position against upper section 27.

Floor 5 is provided with transport wheels 36 that allow lower section 28 to be displaced over base plate 37 perpendicular to the picture plane.

In the left half of the figure, height-adjusting screws 33 are fully tightened and connecting element 30 sealed. Transport wheels 36 are lifted off of base plate 37. In this position the device is ready to operate. Unscrewing height-adjusting screws 33 will lower lower section 28 until transport wheels 36 rest on base plate 37. Height-adjusting screws 33 can then be pivoted to the side out of slots 34 and lower section 28 displaced in the direction specified so that the powder can be removed. The gap left between the flanges when the lower section has been lowered has been exaggerated for the sake of illustration in the drawing. A gap of only a few millimeters will of course be adequate.

Lower section 28 accordingly assumes in conjunction with floor 5 the additional function of powder outtake without necessitating any increase in the overall height of the device. The circumferential edge 38 that demarcates lower section 28 from floor 5 will be critically positioned relative to mechanism 3 as described above.

The object of the invention is preferably employed to obtain powder from what are called superalloys, which are preferred for the manufacture of components subject to high thermal and mechanical stress as well as to obtain powder from precious and semiprecious metals, which are preferred for the manufacture of electric contacts (silver and silver alloys for example) and in dentistry.

I claim:

1. Device for manufacturing powder by dividing a melt into particles and then cooling the particles until they harden, comprising: means for dividing the melt; a container below said means for dividing the melt and comprising substantially a stationary vertical shaft with a vertical axis for cooling the particles; powder outtake means communicating with the shaft; said powder outtake means comprising a lower section of the shaft and having substantially the same cross-section as an upper section, both sections being connected with releasable connecting means and being separatable from each other in a direction perpendicular to the axis of the shaft; said upper section and said lower section when connected together forming vertical falling paths for said particles, all falling paths having substantially identical lengths parallel to said vertical axis, solidified particles collecting at the bottom of said lower section, said lower section being dropped downward and separating from said upper section upon release of said connecting means, said lower section after having dropped downward being movable perpendicular to said vertical axis and away from beneath said upper section for removal of the collected solidified particles.

2. Device according to claim 1, wherein said lower section has transport wheels.

3. Device according to claim 2, wherein said connecting element comprises two flanges which can be fastened together with height-adjusting screws.

4. Device according to claim 1, said lower section has a floor shaped like a spherical surface with a center of curvature located substantially in the vicinity of said means for dividing the melt.

5. Device according to claim 1, wherein said connecting means comprises flanges on said upper and lower sections along a cross-sectional plane at which said lower section is joined to said upper section; height adjusting screws holding said flanges together when said lower section is joined to said upper section, said screws being released for dropping downward said lower section through a substantially small distance for separation from said upper section; and transport wheels beneath said lower section for supporting said lower section when separated and dropped from said upper section, said transport wheels moving said lower section for removal of the solidified collected particles.

6. Device according to claim 5, wherein said height adjusting screws comprise threaded elements pivotably fastened to one of said flanges and pivotably movable into slots of the other one of said flanges; and wing nuts threaded onto the other ends of said threaded elements.

7. Device for manufacturing powder by dividing a melt into particles and then cooling the particles until they harden, comprising: means for dividing the melt; a container below said means for dividing the melt and comprising substantially a stationary vertical shaft with a vertical axis for cooling the particles; powder outtake means communicating with the shaft; said powder outtake means comprising a lower section of the shaft and having substantially the same cross-section as an upper section, both sections being connected with releasable connecting means and being separatable from each other in a direction perpendicular to the axis of the shaft; said upper section and said lower section when connected together forming vertical falling paths for said particles, all falling paths having substantially identical lengths parallel to said vertical axis, solidified particles collecting at the bottom of said lower section, said lower section being dropped downward and separating from said upper section upon release of said connecting means, said lower section after having dropped downward being movable perpendicular to said vertical axis and away from beneath said upper section for removal of the collected solidified particles; said connecting means comprising flanges on said upper and lower sections along a cross-sectional plane at which said lower section is joined to said upper section; height adjusting screws holding said flanges together when said lower section is joined to said upper section, said screws being released for dropping downward said lower section through a substantially small distance for separation from said upper section; transport wheels beneath said lower section for supporting said lower section when separated and dropped from said upper section, said transport wheels moving said lower section away from beneath said upper section for removal of the solidified collected particles; said height adjusting screws comprising threaded elements having one end pivotably attached to flanges of one of said sections and being pivotably movable into slots in a flange of the other one of said sections, and wing nuts threaded onto the other ends of said screw elements; said lower section having a bottom shape in form of a spherical surface with a center of curvature located substantially in the vacinity of said means for dividing the melt.

* * * * *